US011965279B2

(12) United States Patent
Li et al.

(10) Patent No.: US 11,965,279 B2
(45) Date of Patent: Apr. 23, 2024

(54) SHELL STRUCTURE OF CLOTHING TREATING DEVICE, AND CLOTHING TREATING DEVICE

(71) Applicants: QINGDAO HAIER LAUNDRY ELECTRIC APPLIANCES CO., LTD., Shandong (CN); HAIER SMART HOME CO., LTD., Shandong (CN)

(72) Inventors: Wenwei Li, Shandong (CN); Benfu Xing, Shandong (CN); Xinhua Zhang, Shandong (CN); Shaolei Yi, Shandong (CN); Tong Yu, Shandong (CN)

(73) Assignees: QINGDAO HAIER LAUNDRY ELECTRIC APPLIANCES CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 552 days.

(21) Appl. No.: 16/969,347

(22) PCT Filed: Jan. 31, 2019

(86) PCT No.: PCT/CN2019/074135

§ 371 (c)(1),
(2) Date: Aug. 12, 2020

(87) PCT Pub. No.: WO2019/157971

PCT Pub. Date: Aug. 22, 2019

(65) Prior Publication Data

US 2021/0087741 A1 Mar. 25, 2021

(30) Foreign Application Priority Data

Feb. 13, 2018 (CN) ..... 201810148820.3
Feb. 13, 2018 (CN) ..... 201810148828.X
Feb. 13, 2018 (CN) ..... 201810148836.4

(51) Int. Cl.
*D06F 39/12* (2006.01)
*D06F 31/00* (2006.01)

(52) U.S. Cl.
CPC ..... *D06F 39/12* (2013.01); *D06F 31/005* (2013.01)

(58) Field of Classification Search
CPC ..... D06F 39/12; D06F 29/00; D06F 58/02; D06F 58/20; D06F 34/26; D06F 58/30; D06F 29/005
(Continued)

(56) References Cited

U.S. PATENT DOCUMENTS 2,517,421 A * 8/1950 Geldhof ..... D06F 58/263 34/604
3,545,235 A * 12/1970 Menk ..... D06F 58/02 68/19.2
(Continued)

FOREIGN PATENT DOCUMENTS

CN 101328661 A 12/2008
CN 101570933 A 11/2009
(Continued)

OTHER PUBLICATIONS

Chikuchishin et al., "Washing Machine", Sep. 2017, JP 2017-169928-A—Machine Translation (Year: 2017).*
(Continued)

*Primary Examiner* — David G Cormier
*Assistant Examiner* — Thomas Bucci
(74) *Attorney, Agent, or Firm* — BUCHANAN INGERSOLL & ROONEY PC

(57) ABSTRACT

A shell structure of a clothing treating device comprises a rear U-shaped plate, the rear U-shaped plate being bent at
(Continued)

two vertical lines to form a left side wall, a right side wall and a rear side wall of a shell, with a cross section being U-shaped. The left side wall and the right side wall are respectively provided with at least one handle part, and the rear U-shaped plate is provided with an air vent communicating with an inside of the shell. As a result, the shell structure of a machine body of the clothing treating device is simplified, the strength is improved, and the assembly efficiency is improved. Also, an air duct arranged in the clothing treating device communicates with the air vent, so that the purpose of exchanging air with the outside through the air vent is realized.

10 Claims, 10 Drawing Sheets

(58) Field of Classification Search
USPC ..... 68/3 R
See application file for complete search history.

(56) References Cited

U.S. PATENT DOCUMENTS

| | | | | | |
|---|---|---|---|---|---|
| 4,516,335 | A * | 5/1985 | Aoki | D06F 58/02 | 34/608 |
| 6,039,111 | A | 3/2000 | Kawaguchi et al. | | |
| 2006/0225467 | A1* | 10/2006 | Lim | D06F 25/00 | 68/19.2 |
| 2006/0272363 | A1 | 12/2006 | Chu et al. | | |
| 2009/0277034 | A1* | 11/2009 | Wilson | D06F 58/20 | 34/235 |

FOREIGN PATENT DOCUMENTS

| | | | | | |
|---|---|---|---|---|---|
| CN | 201538907 | U | | 8/2010 | |
| CN | 101942755 | A | * | 1/2011 | |
| CN | 101942755 | A | | 1/2011 | |
| CN | 201826162 | U | | 5/2011 | |
| CN | 202658441 | U | | 1/2013 | |
| CN | 103132285 | A | | 6/2013 | |
| CN | 203741597 | U | | 7/2014 | |
| CN | 104652085 | A | | 5/2015 | |
| CN | 106809506 | A | | 6/2017 | |
| CN | 108754995 | A | | 11/2018 | |
| CN | 208151703 | U | | 11/2018 | |
| CN | 208151704 | U | | 11/2018 | |
| CN | 208151705 | U | | 11/2018 | |
| CN | 208151706 | U | | 11/2018 | |
| EP | 2975172 | A1 | * | 1/2016 | D06F 39/12 |
| EP | 2975172 | A1 | | 1/2016 | |
| JP | S5570091 | U | | 5/1980 | |
| JP | H10261888 | A | | 9/1998 | |
| JP | 2006228924 | A | | 8/2006 | |
| JP | 2011206611 | A | | 10/2011 | |
| JP | 2017169928 | A | | 9/2017 | |
| JP | 2017169928 | A | * | 9/2017 | |
| WO | 2004097098 | A1 | | 11/2004 | |
| WO | WO-2004097098 | A1 | * | 11/2004 | D06F 29/00 |

OTHER PUBLICATIONS

Chi et al., "Drum Washing Machine Having Drawer Under Outer Drum", Jan. 2011, CN-101942755-A—Machine Translation (Year: 2011).*

International Search Report (PCT/ISA/210), with translation, and Written Opinion (PCT/ISA/237) dated Apr. 26, 2019, by the Chinese Patent Office as the International Searching Authority for International Application No. PCT/CN2019/074135.

European Search Report dated Nov. 10, 2020, issued in corresponding European Application No. 19753974.5. (2 pages).

Office Action (Notice of Reasons for Refusal) dated Mar. 1, 2022, in corresponding Japanese Patent Application No. 2020-542976 and English translation of the Office Action. (12 pages).

Office Action (Request for the Submission of an Opinion) dated Aug. 22, 2022, in corresponding Korean Patent Application No. 10-2020-7026171 and English translation of the Office Action. (9 pages).

* cited by examiner

SHELL STRUCTURE OF CLOTHING TREATING DEVICE, AND CLOTHING TREATING DEVICE

TECHNICAL FIELD

The present disclosure relates to the field of clothing treating devices, and in particularly, to a supporting frame of a clothing treating device having two clothing treating drums, and more particularly, to a shell structure applied to the clothing treating device.

BACKGROUND

Clothing treating devices being as a household appliance have been widely used in people's lives. There are a variety of shells of clothing treating device, some of shells have an integral structure, and some of shells are of a multi-piece assembly structure. However, the shells of the clothing treating device with the integral structure has the defects of high processing cost and high requirement on material performance, and the shells of the clothing treating device with a multi-piece assembly structure has the defects of difficult forming and low strength due to the problem of a connection mode.

The shell of the clothing processing device is composed of a supporting frame with certain strength and a casing covering plate covered outside the supporting frame. In the conventional clothes treating devices, a plurality of support bars are generally formed into edges of a rectangular parallelepiped to form a rectangular parallelepiped, and then the contact positions of the support bars are fixed to form a supporting frame of the clothes treating devices.

For example, in a Chinese patent with the patent number 200920241062.6, a shell of a clothing treating device is disclosed, the shell includes a front panel, a rear panel, a left side plate and a right side plate, an upper frame composed of a left upper edge beam, an upper front beam and a right upper edge beam is fixedly connected with the top of the rear panel; a lower frame composed of a left lower edge beam, a lower front beam and a right lower edge beam is fixedly connected with the bottom of the rear panel; the left side plate is fixedly mounted between the left upper edge beam and the lower left edge beam, the front panel is fixedly mounted between the upper front beam and the lower front beam, and the right side plate is fixedly mounted between the right upper edge beam and the right lower edge beam.

However, when the conventional supporting frame is applied to the double-drum laundry treating devices, the supporting frame provides insufficient support strength, and cannot provide sufficient mounting support strength for the upper and lower drums.

In view of the above, the present disclosure is set forth.

SUMMARY

An objective of the disclosure is to provide a side plate structure of a clothing treating device, which aims to realize the purpose of covering a side part of two clothing treating drums which are arranged up and down. Another objective is to achieve the purpose of convenient transportation of the clothing treating device. Another objective is that the two clothing treating drums in the clothing treating device can be respectively correspondingly maintained and overhauled. Another objective is to provide a shell structure of a clothing treating device, to achieve the purposes of reasonably arranging a ventilation channel on a machine body and reducing the internal temperature of an inside of the shell. In order to realize the purposes of the disclosure, the following technical scheme is adopted:

A shell structure of a clothing treating device is disclosed. The shell structure comprises a rear U-shaped plate. The rear U-shaped plate is bent at two vertical lines to form a left side wall, a right side wall and a rear side wall of a shell, with a cross section being U-shaped, of the clothing treating device. An upper overhauling installation opening and a lower overhauling installation opening are arranged on the rear side wall. An upper rear back cover plate and a lower rear back cover plate which respectively cover the upper overhauling installation opening and the lower overhauling installation opening overhauling installation openings are arranged on the rear side wall.

Further, the clothing treating device comprises a first clothing treating drum and a second clothing treating drum which are arranged in longitudinal order. The upper overhauling installation opening corresponds to the first clothing treating drum and part of the second clothing treating drum, and the lower overhauling installation opening corresponds to at least another part of the second clothing treating drum.

Further, the upper overhauling installation opening is an opening with an upper horizontal width being larger than a lower horizontal width. An upper side edge of the upper overhauling installation opening is an arc line segment which gradually bents downward from a center to two sides. Two side edges of the upper overhauling installation opening are line segments symmetrically arranged about the vertical median line of the rear side wall. A lower side edge of the upper overhauling installation opening is a horizontally extending line segment. Preferably, an arc chamfer is arranged at an intersection of adjacent edges of the upper overhauling installation opening.

Further, the lower overhauling installation opening is a rectangular opening, and a horizontal width of the lower overhauling installation opening is larger than a maximum horizontal width of the upper overhauling installation opening. Preferably, four corners of the rectangular opening are respectively provided with arc chamfers.

Further, the upper rear back cover plate and the lower rear back cover plate are respectively detachably and fixedly arranged on one side of the rear side wall. Preferably, the upper rear back cover plate is fixedly installed on the rear side wall, and part of the upper rear back cover plate is correspondingly overlapped with the whole area of the upper overhauling installation opening in horizontal direction. The lower rear back cover plate is fixedly installed on the rear side wall, and part of the lower rear back cover plate is correspondingly overlapped with the whole area of the lower overhauling installation opening in horizontal direction. Further preferably, a periphery of the upper rear back cover plate goes beyond the upper overhauling installation opening and is attached and contacted with the rear side wall, and the attachment and contact part is detachably and fixedly mounted via at least one screw. A periphery of the lower rear back cover plate goes beyond the lower overhauling installation opening, and the lower rear back cover plate is attached and contacted with rear side wall, and is detachably and fixedly mounted on the rear side wall at an attachment and contact part via at least one screw.

Further, the left side wall and the right side wall of the shell are symmetrically arranged about the vertical median line of the rear U-shaped plate. A middle part of the left side wall and a middle part of the right side wall of the shell are respectively provided with at least two handle parts. Preferably, a left side and a right side of the left side wall of the shell are respectively provided with one handle part, and a left side and a right side of the right side wall of the shell are respectively provided with one handle part. Further preferably, all of the handle parts are arranged at a position between the first clothing treating drum and the second clothing treating drum.

Further, an upper part of the left side wall or an upper part of the right side wall of the clothing treating device is provided with the air vent. The air vent communicates with an end part of an air duct arranged in the clothing treating device, so that outside air flows in an inside of the air duct through the air vent. Preferably, a grid-shaped shielding cover is arranged at the air vent, and the grid-shaped shielding cover covered the air vent to prevent external water flow from flowing into the inside of the shell of the clothing treating device. Further preferably, the grid-shaped shielding cover comprises horizontal shielding ribs which are horizontally arranged, an interval is formed between two adjacent horizontal shielding ribs. Each of the horizontal shielding ribs is inclined from top to bottom towards the outside of the shell of the clothing treating device to guide water flow outside the clothing treating device to flow along the horizontal shielding rib and not flow in the air vents.

Further, the left side wall and the right side wall of the clothing treating device are respectively provided with moldings arranged from top to bottom at intervals. The moldings arranged on the left side wall and the moldings arranged on the right side wall are symmetrically arranged. Preferably, the air vent is at least partially overlapped with one molding of a side wall of the clothing treating device. Further preferably, an upper side and a lower side of the handle part are respectively arranged close to the moldings in an adjacent manner.

Further, a lower part of the left side wall and a lower part of the right side wall of the clothing treating device are provided with screw holes which are horizontally arranged at intervals, so that screws pass through the screw holes to fixedly connect the rear U-shaped plate with a supporting frame of the clothing treatment device.

The disclosure also relates to a clothing treating device which is provided with a first clothing treating drum and a second clothing treating drum for treating clothes and is provided with any one of the shell structures.

By adopting the above technical solutions, the disclosure have the following advantages compared with the prior art:

The shell of the clothing treating device is provided with the rear U-shaped plate comprising the left side wall, the right side wall and the rear side wall, so that the shell structure of a machine body of the clothing treating device is simplified, the strength is improved, and the assembly efficiency is improved. Simultaneously, setting up two detachable back cover plates up and down on the rear side wall of the rear U-shaped plate is convenience to assemble and maintain an upper portion and a lower portion by step.

Another objective of the present disclosure is to provide a shell structure of a clothes treatment device, so as to achieve the purposes of reasonably arranging an air duct in the clothing treating device and reducing a temperature inside the shell. In order to realize the purpose of the disclosure, the following technical solution is adopted:

A shell structure of a clothing treating device is disclosed. The shell comprises a rear U-shaped plate. The rear U-shaped plate is bent at two vertical lines to form a left side wall, a right side wall and a rear side wall of a shell, with a cross section being U-shaped, of the clothing treating device. The left side wall and the right side wall of the shell are respectively provided with at least one handle part. The rear U-shaped plate is also provided with an air vent communicated with an inside of the shell.

Further, the left side wall and the right side wall of the shell are symmetrically about a vertical median line of the rear U-shaped plate. A middle part of the left side wall and a middle part of the right side wall of the shell are respectively provided with at least two handle parts. All of the handle parts are arranged at a same horizontal height of the rear U-shaped plate. Preferably, a left side and a right side of the left side wall of the shell are respectively provided with one handle part, and a left side and a right side of the right side wall of the shell are respectively provided with one handle part.

Further, the handle part comprises a handle body fixedly mounted on the rear U-shaped plate. A groove sunk towards an inside of the clothing treating device is arranged on the handle body, and an opening of the groove faces an outside of the clothing treating device. Preferably, the opening of the groove faces the outside of the clothing treating device and is inclined downward.

Further, the clothing treating device comprises a first clothing treating drum and a second clothing treating drum which are arranged in longitudinal order. The handle part is arranged at a position between the first clothing treating drum and the second clothing treating drum.

Further, the air vent is arranged on an upper part of the left side wall or the right side wall, formed by the rear U-shaped plate, of the clothing treating device. The air vent communicates with an end part of an air duct arranged in the clothing treating device, so that outside air flows in an inside of the air duct through the air vent. Preferably, a grid-shaped shielding cover is arranged at the air vent, and the grid-shaped shielding cover covers the air vent to prevent external water flow from flowing into the inside of the shell of the clothing treating device.

Further, the grid-shaped shielding cover comprises horizontal shielding ribs which are horizontally arranged, an interval is formed between two adjacent horizontal shielding ribs. Each of the horizontal shielding ribs is inclined from top to bottom towards the outside of the shell of the clothing treating device to guide water flow outside the clothing treating device to flow along the horizontal shielding rib and not flow in the air vent. Preferably, upper sides of the horizontal shielding ribs are arranged on a same vertical plane, and an interval is formed between a lower side of one horizontal shielding rib and the upper side of another horizontal shielding rib adjacent to and below the one horizontal shielding rib to allow air flow to pass through the air vent through the interval. Further preferably, the lower side of one horizontal shielding rib is lower than or flushes with other horizontal shielding rib adjacent to and below the one horizontal shielding rib.

Further, two ends of each of the horizontal shielding ribs are respectively fixed on a supporting ring. A size of a periphery of the supporting ring is equal to a perimeter of the air vent and the supporting ring is hermetically connected with the air vent. Preferably, the grid-shaped shielding cover is provided with at least one vertical shielding rib extending vertically, two ends of the vertical shielding rib are fixedly connected with the supporting ring respectively. The vertical shielding rib sequentially penetrates through the horizontal shielding ribs and is fixedly connected with the horizontal shielding ribs. Further preferably, the grid-shaped shielding cover is integrally with the rear U-shaped plate of the clothing treating device.

Further, the left side wall and the right side wall of the clothing treating device are respectively provided with moldings arranged from top to bottom at intervals. The moldings arranged on the left side wall and the moldings arranged on the right side wall are symmetrically arranged. Preferably, the air vent is at least partially overlapped with the molding of the left side wall or the right side wall of the clothing treating device. Further preferably, an upper side and a lower side of the handle part are respectively arranged close to the moldings in an adjacent manner.

Further, a lower part of the left side wall and a lower part of the right side wall of the clothing treating device are provided with screw holes which are horizontally arranged at intervals, so that screws pass through the screw holes to fixedly connect the rear U-shaped plate with a supporting frame of the clothing treatment device. Preferably, a water outlet is arranged on a lower end of the rear side wall of the clothing treating device, and a water inlet is arranged on one side of an upper end of the rear side wall, and a power line mounting opening is arranged on another side of the upper end of the rear side wall. Further preferably, the rear side wall is provided with an overhauling installation opening, a rear back cover plate is detachably installed on the rear U-shaped plate, and the rear back cover plate is fixedly installed and covers the overhauling installation opening.

The disclosure also relates to a clothing treating device which is provided with a first clothing treating drum and a second clothing treating drum for treating clothes and is provided with any one of the shell structures.

By adopting the above technical solutions, the disclosure have the following advantages compared with the prior art:

The shell of the clothing treating device is provided with the rear U-shaped plate comprising the left side wall, the right side wall and the rear side wall, so that the shell structure of a machine body of the clothing treating device is simplified, the strength is improved, and the assembly efficiency is improved. Meanwhile, the air vent is integrally formed on the rear U-shaped plate, so that heat dissipation and ventilation in the clothes treatment device are facilitated. Also, the air duct arranged in the clothing treating device is communicated with the air vent, so that the purpose of exchanging air with an outside through the air vent arranged on the shell is realized.

The shell of the clothing treating device is provided with the detachable rear back cover plate, so that the shell structure of the machine body is simplified, the strength is improved, and the assembly efficiency is improved. Simultaneously, setting up the detachable rear back apron on the rear side wall of the rear U-shaped plate is convenience to assemble and maintain the clothing treating device by step.

Another object of the present disclosure is to provide a side plate structure of a clothes treatment device, which can achieve the purposes of reasonably arranging an air dust in the clothing treating device and reducing the internal temperature of the shell. In order to realize the purpose of the disclosure, the following technical solution is adopted:

A side plate structure of a clothing treating device is disclosed. The side plate is provided with at least one handle part for a user to hold when moving the clothing treating device. The side plate is also provided with an air vent communicated with the inside of the clothing treating device.

Further, a middle part of each of the side plates is provided with at least two handle parts, and all handle parts are arranged at a same horizontal height of the side plates. Preferably, a left side and a right side of the side plate are respectively provided with one handle part.

Further, the handle part comprises a handle body fixedly mounted on the side plate. A groove sunk towards the inside of the clothing treating device is arranged on the handle body, and an opening of the groove faces an outside of the clothing treating device. Preferably, the opening of the groove faces the outside of the clothing treating device and is inclined downward.

Further, the clothing treating device comprises a first clothing treating drum and a second clothing treating drum which are arranged in longitudinal order, and the handle part is arranged at a position between the first clothing treating drum and the second clothing treating drum.

Further, the air vent is arranged on an upper part of the side plate and communicates with an end part of an air duct arranged in the clothing treating device, so that the outside air flows in an inside of the air duct through the air vent. Preferably, a grid-shaped shielding cover is arranged at the air vent, and the grid-shaped shielding cover covers the air vent to prevent external water flow from flowing into the inside of the shell of the clothing treating device.

Further, the grid-shaped shielding cover comprises horizontal shielding ribs which are horizontally arranged, an interval is formed between two adjacent horizontal shielding ribs. The horizontal shielding rib is inclined from top to bottom towards the outside of the shell of the clothing treating device to guide water flow outside the clothing treating device to flow along the horizontal shielding rib and not flow in the air vent. Preferably, upper sides of the horizontal shielding ribs are arranged on a same vertical plane, and an interval is formed between a lower side of one horizontal shielding rib and the upper side of another horizontal shielding rib adjacent to and below the one horizontal shielding rib to allow air flow to pass through the air vent through the interval. Further preferably, the lower side of one horizontal shielding rib is lower than or flushes with other horizontal shielding rib adjacent to and below the one horizontal shielding rib.

Further, two ends of each of the horizontal shielding ribs are respectively fixed on a supporting ring, and a size of a periphery of the supporting ring is equal to a perimeter of the air vent and the supporting ring is hermetically connected with the air vent. Preferably, the grid-shaped shielding cover is provided with at least one vertical shielding rib extending vertically, two ends of the vertical shielding rib are fixedly connected with the supporting ring respectively. The vertical shielding rib sequentially penetrates through the horizontal shielding ribs and is fixedly connected with the horizontal shielding ribs. Further preferably, the grid-shaped shielding cover is integrally with the side plate of the clothing treating device.

Further, the side plate of the clothing treating device is provided with moldings arranged from top to bottom at intervals. Preferably, the air vent is at least partially overlapped with the molding of the side plate of the clothing treating device. Further preferably, an upper side and a lower side of the handle part are respectively arranged close to the moldings in an adjacent manner.

Further, a lower part of the side plate of the clothing treating device is provided with screw holes which are horizontally arranged at intervals, so that screws pass through the screw holes to fixedly connect the side plate with the supporting frame of the clothing treatment device.

Another object of the present disclosure is to provide a clothing treating device, which includes a first clothing treating drum and a second clothing treating drum for treating laundry and is provided with any one of the side plate structures.

By adopting the above technical solutions, the disclosure have the following advantages compared with the prior art:

The side plate of the clothing treating device is provided with the handle part, so that a user can conveniently and quickly move the clothing treating device after directly holding the handle part. Meanwhile, the air vent is formed in the side plate, so that heat dissipation and ventilation in the clothing treating device are facilitated. In addition, the air duct of the clothing treating device can be communicated with the outside through the air vent, so that the air exchange channel of the clothing treating device is arranged on the side of the clothing treating device, and the clothing treating device can be assembled conveniently and the assembly efficiency is improved.

Another objective of the present disclosure is to provide a rear plate structure of a clothing treating device, so as to realize the purpose of covering the back of two clothing treating drums placed up and down. Another purpose of facilitating the user to maintain and repair the internal the clothing treatment device is realized. In order to realize the purposes of the disclosure, the following technical solution is adopted:

A rear plate structure of a clothing treating device is disclosed. The clothing treating device is provided with a supporting frame, the supporting frame comprises two vertical beams which are arranged at a rear side of the clothing treating device and extend vertically. A rear side of the supporting frame is provided with an upper back plate and a lower back plate which are arranged up and down and fixedly on the two vertical beams.

Further, the supporting frame comprises a rear reinforcing member arranged at a middle of the rear side of the clothing treating device. Two ends of the rear reinforcing member are respectively fixedly connected with the two vertical beams. The upper back plate is arranged above the rear reinforcing member, and the lower back plate is arranged below the rear reinforcing member. Preferably, the rear reinforcing member extends horizontally, and two ends of the rear reinforcing member are fixedly connected with the two vertical beams at the rear side of the supporting frame respectively.

Further, the upper back plate covers an area from the rear reinforcing member to a top of the supporting frame, and a left side and a right side of the upper back plate are contacted and fixedly connected with the vertical beam on corresponding side respectively. The lower back plate covers an area from the rear reinforcing member to a bottom of the supporting frame, and a left side and a right side of the lower back plate are contacted and fixedly connected with the vertical beam on the corresponding side respectively. Preferably, a lower side of the upper back plate is correspondingly contacted with and fixedly connected with an upper side of the rear reinforcing member, and an upper side of the lower back plate is correspondingly contacted with and fixedly connected with a lower side of the rear reinforcing member. Preferably, two sides of the supporting frame are respectively covered with a side plate, and rear side edges of the side plates on the two sides of the supporting frame are respectively provided with a horizontal flange bent towards a direction close to each other, the horizontal flange is attached and contacted with the vertical beam on the corresponding side. The left side and the right side of the upper back plate and the left side and the right side of the lower back plate are correspondingly attached and contacted with the horizontal flange of the side plates respectively.

Further, the clothing treating device comprises a first clothing treating drum and a second clothing treating drum which arranged in longitudinal order, and the rear reinforcing member is arranged between the first clothing treating drum and the second clothing treating drum. Preferably, the rear reinforcing member is provided with at least one mounting hole for allowing a package positioning rod to pass through.

Further, the upper back plate is provided with at least one molding protruding towards one side of the upper back plate; and the lower back plate is provided with at least one molding protruding towards one side of the lower back plate.

Further, a bottom of the supporting frame is composed of a base, and an upper side of a rear side of the base is contacted and fixedly connected with a lower side of the lower back plate.

Further, a top of the supporting frame is provided with a table top which horizontally covers a top of the supporting frame, a rear side of the table top is provided with a flange bent downwards. A lower side of the flange is contacted and fixedly connected with an upper side of the upper back plate.

Further, the first clothing treating drum or the second clothing treating drum is a drying drum configured to dry clothes. A rear part of at least one clothing treating drum is fixedly mounted on the supporting frame via an installation plate. A notch is provided on the upper back plate and/or the lower back plate, and the notch and the installation plate at the rear part of the first clothing treating drum and/or the second clothing treating drum are arranged in a corresponding superposition way. Preferably, the installation plate at the rear part of the first clothing treating drum and/or the second clothing treating drum is correspondingly attached to the upper back plate and/or the lower back plate. Further preferably, the installation plate at the rear part of the first clothing treating drum and the upper back plate are mounted at two opposite sides of the two vertical beams at the rear side of the supporting frame. And/or the installation plate at the rear part of the second clothing treating drum and the lower back plate are mounted at two opposite sides of the two vertical beams at the rear side of the supporting frame.

Further, a top of the upper back plate is an inclined plane which is gradually bent downwards from the center to two sides, so that the notch is formed between the upper back plate and the supporting frame at two ends of a top of a rear side of the clothing treating device. Preferably, the rear part of the first clothing treating drum is fixedly arranged on the supporting frame via the installation plate, a water inlet and a power line mounting opening are respectively arranged at two ends of a top part of the installation plate. The water inlet and the power line mounting opening are respectively arranged corresponding to the notch between the upper back plate and the supporting frame. Further preferably, a water outlet for installing a water discharge valve is arranged at the rear side of the base.

The disclosure also relates to a clothing treating device, which is provided with a first clothing treating drum and a second clothing treating drum for treating clothes. The clothing treating device is installed with any one of the rear plate structures.

By adopting the technical solutions, the disclosure have the following advantages compared with the prior art:

Two detachable back cover plates which are arranged up and down are arranged on a back plate of the clothing treating device, so that an upper part and a lower part of the clothing treating device are conveniently assembled and maintained respectively. Meanwhile, the back plates which are arranged in a vertically staggered mode are arranged on the back plates and correspond to the first clothing treating drum and the second clothing treating drum respectively, so that the purposes of assembling, overhauling and maintaining the first clothing treating drum and the second clothing treating drum respectively are achieved, and the convenience of overhauling components inside the shell of a machine body is improved.

Meanwhile, the disclosure has simple structure and obvious effect and is suitable for popularization and application.

DETAILED DESCRIPTION

The present disclosure will be described in further detail with reference to the following embodiments.

As shown in FIGS. 1 to 12, in the embodiments of the present disclosure, a clothing treating device is introduced. The clothing treating device includes a supporting frame 100, the supporting frame 100 is surrounded by a casing surrounding an outside thereof to form a shell. A first clothing treating drum and a second clothing treating drum are arranged up and down inside the shell. The first clothing treating drum and the second clothing treating drum are respectively mounted on the supporting frame via springs and/or shock absorbers. The first clothing treating drum and the second clothing treating drum may have both laundry washing and drying functions, or only a single washing function, or only a single drying function. Preferably, in the embodiments of the present disclosure, the first clothing treating drum disposed upper has only a drying function, and the second clothing treating drum disposed below has both washing and drying functions.

Embodiment 1

Figure 1:
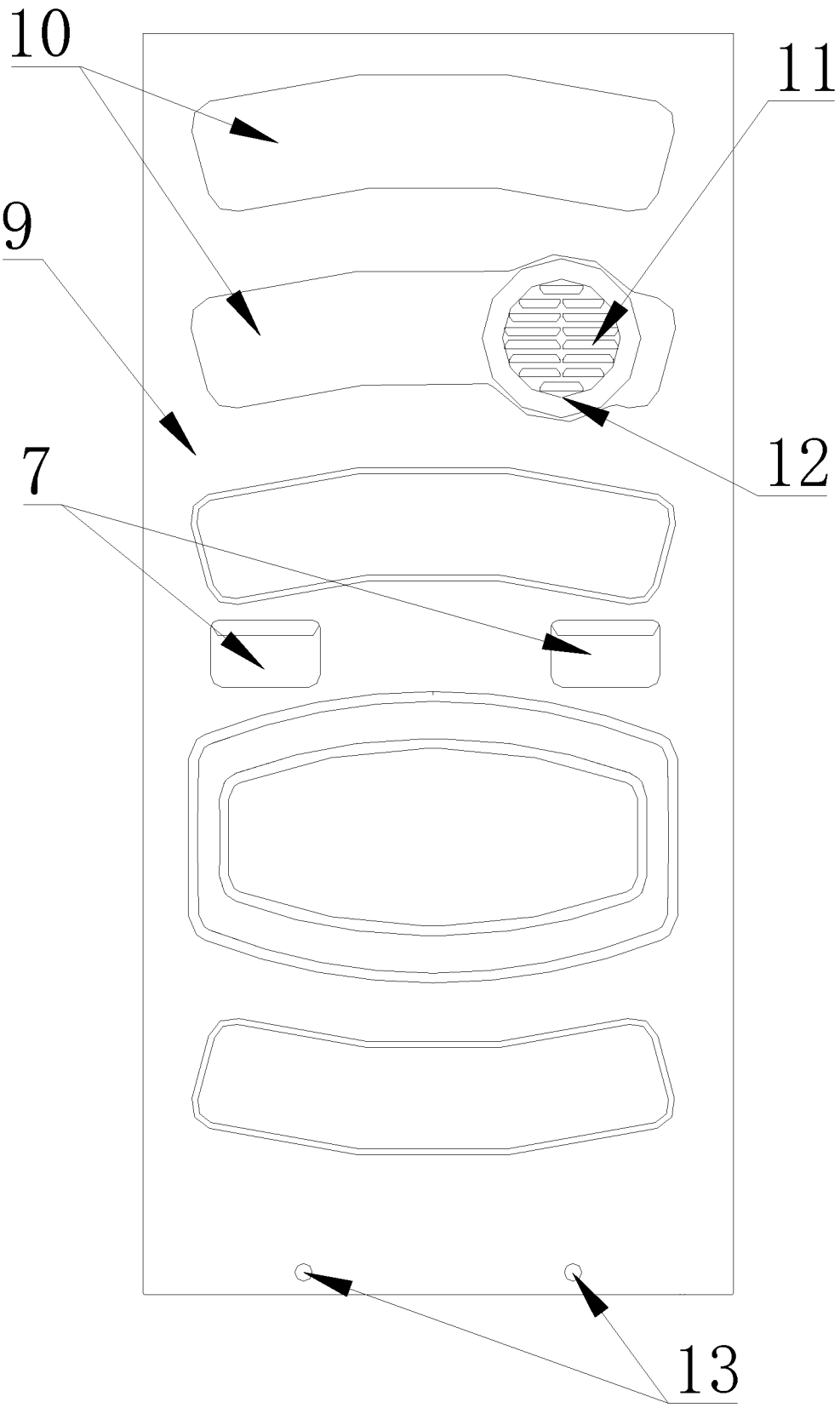
FIG. 1 is a schematic side panel structure of a clothing treating device according to an embodiment of the present disclosure.

As shown in FIG. 1, in the present embodiment, a side plate of a clothing treating device is provided. At least one handle part 7 for a user to hold when moving the clothing treating device is provided on the side plate 9 of the clothing treating device. The side plate 9 is also provided with an air vent 11 communicated with the inside of the clothing treating device.

The side plate of the clothing treating device is provided with the handle part, so that a user can conveniently and quickly move the clothing treating device after directly holding the handle part. Meanwhile, the air vent is arranged on the side plate, so that an air duct of the clothing treating device can be communicated with an outside through the air vent on the side plate, and then an air exchange channel of the clothing treating device can be arranged at a side part of the clothing treating device. The clothing treating device can be assembled conveniently, and the assembling efficiency is improved.

In the embodiment, at least two handle parts 7 are arranged in a middle of the side plate 9, and each of the handle parts 7 is arranged at a same horizontal height of the side plates. Preferably, a left side and a right side of the side plate 9 are respectively provided with one handle part 7. A front end and a rear end of a left side wall and a front end and a rear end of a right side wall of the clothing treating device are respectively provided with the handle parts, so that when two persons move the clothing treating device with larger weight, the four hands can simultaneously carry a machine body.

In the embodiment, the handle part 7 comprises a handle body fixedly mounted on the side plate 9. A groove sunk towards the inside of the clothing treating device is arranged on the handle body, and an opening of the groove faces an outside of the clothing treating device. Preferably, the opening of the groove faces the outside of the clothing treating device and is inclined downward.

In the embodiment, the clothing treating device comprises a first clothing treating drum and a second clothing treating drum which are arranged in longitudinal order, and the handle part 7 is arranged at a position between the first clothing treating drum and the second clothing treating drum. Two handle parts at the same side are arranged at the same height, so that a user can conveniently move the clothing treating device.

In the embodiment, the air vent 11 is arranged on an upper part of the side plate 9 and communicates with an end part of an air duct arranged in the clothing treating device, so that the outside air flows in an inside of the air duct through the air vent. By setting the air vent on the upper part of the side plate, the air vent of the clothing treating device is arranged on an upper part of a machine body, so that the air flowing out or flowing in through the air vent is the air flow on the upper side of the machine body, so as to reduce the interference of the ventilation airflow on the users operating the machine and improve the user's experience effect.

In the embodiment, a grid-shaped shielding cover 12 is arranged at the air vent 11, and the grid-shaped shielding cover 12 covers the air vent 11 to prevent external water flow from flowing into the inside of the shell of the clothing treating device. By setting the grid-shaped shielding cover at the air vent, the water flow attached to an outer wall of the clothing treating device can be blocked, so as to avoid the water flowing into the air vent with the gas, thus ensuring the normal use of the clothing treating device.

In the embodiment, the grid-shaped shielding cover 12 comprises horizontal shielding ribs which are horizontally arranged, an interval is formed between two adjacent horizontal shielding ribs. The horizontal shielding rib is inclined from top to bottom towards the outside of the shell of the clothing treating device to guide water flow outside the clothing treating device to flow along the horizontal shielding rib and not flow in the air vent. Preferably, upper sides of the horizontal shielding ribs are arranged on a same vertical plane, and an interval is formed between a lower side of one horizontal shielding rib and the upper side of another horizontal shielding rib adjacent to and below the one horizontal shielding rib to allow air flow to pass through the air vent through the interval. Further preferably, the lower side of one horizontal shielding rib is lower than or flushes with the upper side of another horizontal shielding rib adjacent to and below the one horizontal shielding rib.

In the embodiment, two ends of each the horizontal shielding rib are respectively fixed on a supporting ring, and a size of a periphery of the supporting ring is equal to a perimeter of the air vent and the supporting ring is hermetically connected with the air vent. Preferably, the grid-shaped shielding cover is provided with at least one vertical shielding rib extending vertically, two ends of the vertical shielding rib are fixedly connected with the supporting ring respectively. The vertical shielding rib sequentially penetrates through the horizontal shielding ribs and is fixedly connected with the horizontal shielding ribs. Further preferably, the grid-shaped shielding cover is integrally with the side plate of the clothing treating device.

In the embodiment, the lateral plate 9 of the clothing treating device is provided with moldings 10 arranged from top to bottom at intervals. An upper part and a lower part of the side plate are respectively provided with the plurality of moldings, so that a supporting strength of the side plate of the clothing treating device is improved, an integral strength of the clothing treating device is further improved, and a vibration of the clothing treating device during operation is reduced. Preferably, the air vent is at least partially overlapped with the molding of the side plate of the clothing treating device, so that the air vent is arranged in the molding, and a peripheral strength of the air vent is further improved. Further preferably, an upper side and a lower side of the handle part are respectively arranged close to the moldings in an adjacent manner, so as to improve a torsion resistance of the handle part in the vertical direction, and to improve the stability of a user when holding the handle part, so as to avoid the falling-off of the handle part.

In the embodiment, a lower part of the side plate 9 of the clothing treating device is provided with screw holes 13 which are horizontally arranged at intervals, so that screws pass through the screw holes to fixedly connect the side plate 9 with the supporting frame 100 of the clothing treatment device.

Embodiment 2

Figure 2:
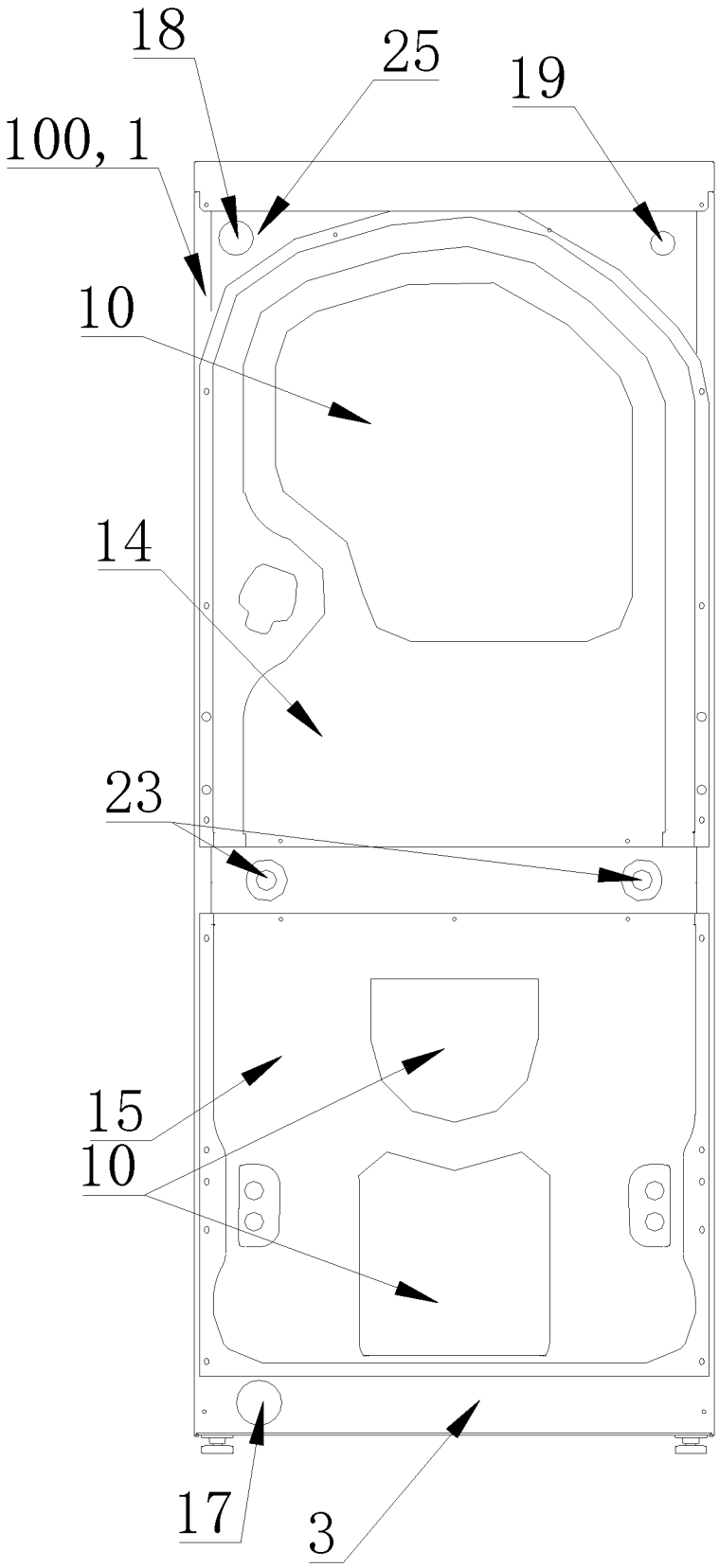
FIG. 2 is a schematic rear view of a clothing treating device according to an embodiment of the present disclosure.
Figure 3:
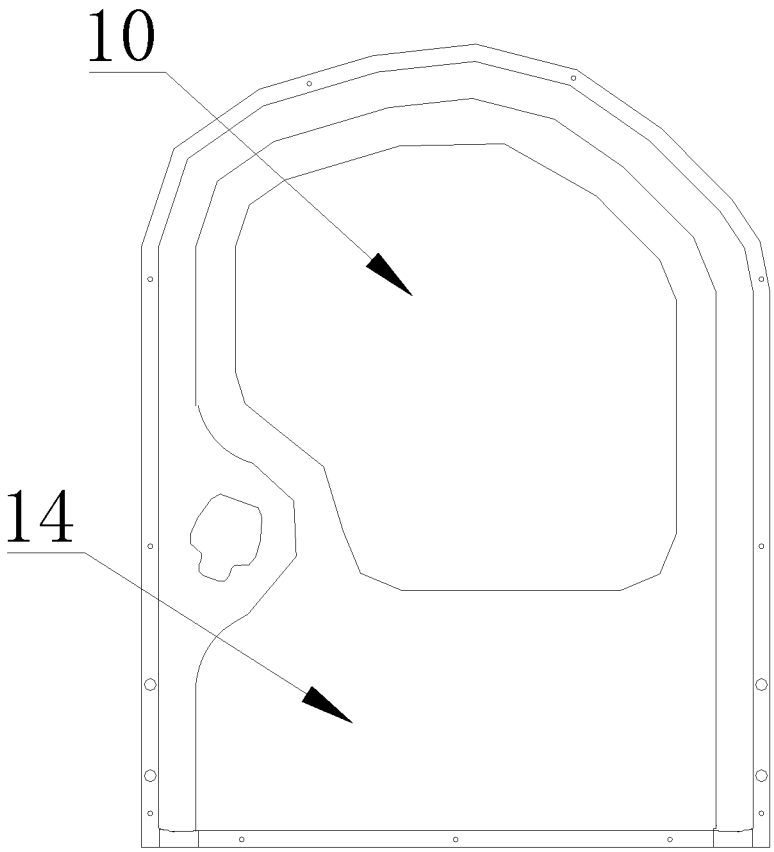
FIG. 3 is a schematic view illustrating an upper back plate structure of a clothing treating device according to an embodiment of the present disclosure.
Figure 4:
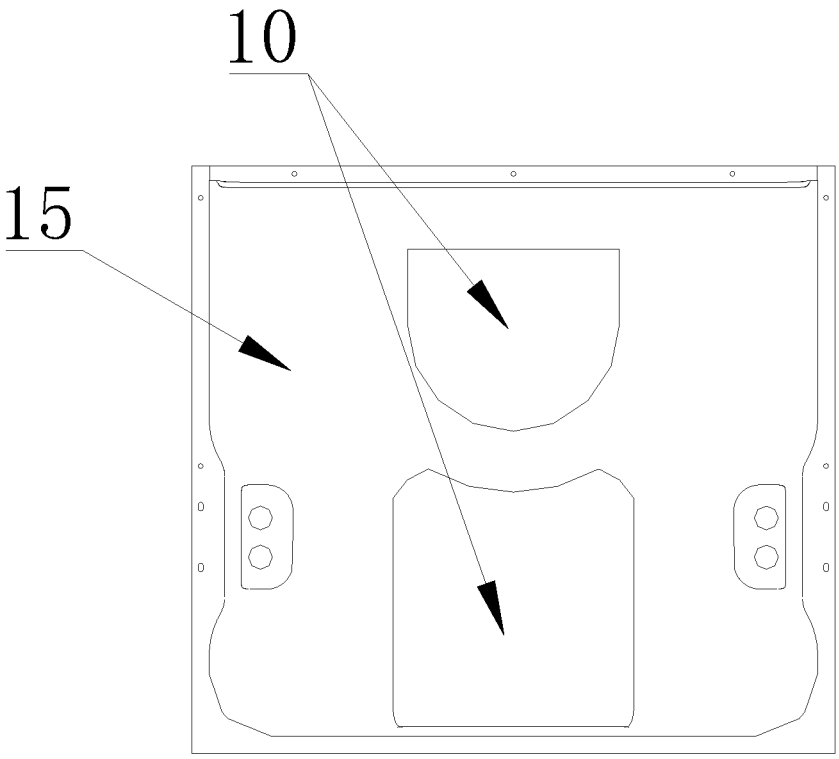
FIG. 4 is a schematic view of a lower back plate structure of a clothing treating device according to an embodiment of the present disclosure.

As shown in FIGS. 2 to 4, a rear plate structure of a clothing treating device is disclosed in the embodiment. The clothing treating device is provided with a supporting frame 100, the supporting frame 100 comprises two vertical beams 1 which are arranged at a rear side of the clothing treating device and extend vertically. A rear side of the supporting frame 100 is provided with an upper back plate 14 and a lower back plate 15 which are arranged up and down and fixedly on the two vertical beams.

Two detachable back cover plates which are arranged up and down are arranged on a back plate of the clothing treating device, so that an upper part and a lower part of the clothing treating device are conveniently assembled and maintained respectively. Meanwhile, the back plates which are arranged in a vertically staggered mode are arranged on the back plates and correspond to the first clothing treating drum and the second clothing treating drum respectively, so that the purposes of assembling, overhauling and maintaining the first clothing treating drum and the second clothing treating drum respectively are achieved, and the convenience of overhauling components inside the shell of a machine body is improved.

In the embodiment, the supporting frame 100 comprises a rear reinforcing member 8 arranged at a middle of the rear side of the clothing treating device. Two ends of the rear reinforcing member 8 are respectively fixedly connected with the two vertical beams 1. The upper back plate 4 is arranged above the rear reinforcing member, and the lower back plate 15 is arranged below the rear reinforcing member. Preferably, the rear reinforcing member 8 extends horizontally, and two ends of the rear reinforcing member 8 are fixedly connected with the two vertical beams 1 at the rear side of the supporting frame 100 respectively. Preferably, two sides of the supporting frame are respectively covered with the side plate 9, and rear side edges of the side plates 9 on the two sides of the supporting frame are respectively provided with a horizontal flange bent towards a direction close to each other, the horizontal flange is attached and contacted with the vertical beam 1 on the corresponding side. The left side and the right side of the upper back plate 14 and the left side and the right side of the lower back plate 15 are correspondingly attached and contacted with the horizontal flange of the side plates 9 respectively.

In the embodiment, the rear reinforcing member 8 is provided with at least one mounting hole 23 for allowing a package positioning rod to pass through.

By setting up the rear reinforcing member, a mounted position for the package positioning rod is provided. During the transportation of the clothing treating device, the package positioning rod passes through the rear reinforcing member, the first clothing treating drum and/or the second clothing treating drum successively from the back to the front, so as to realize the purpose of limiting support for the first clothing treating drum and/or the second clothing treating drum in the transportation process.

In the embodiment, the upper back plate 14 covers an area from the rear reinforcing member 8 to a top of the supporting frame 100, and a left side and a right side of the upper back plate 14 are contacted and fixedly connected with the vertical beam 1 on corresponding side respectively. The lower back plate 15 covers an area from the rear reinforcing member 8 to a bottom of the supporting frame 100, and a left side and a right side of the lower back plate 15 are contacted and fixedly connected with the vertical beam 1 on the corresponding side respectively. Preferably, a lower side of the upper back plate 14 is correspondingly contacted with and fixedly connected with an upper side of the rear reinforcing member 8, and an upper side of the lower back plate 15 is correspondingly contacted with and fixedly connected with a lower side of the rear reinforcing member 8.

In this embodiment, the clothing treating device comprises a first clothing treating drum and a second clothing treating drum which arranged in longitudinal order, and the rear reinforcing member is arranged between the first clothing treating drum and the second clothing treating drum.

In the embodiment, the upper back plate 14 and the lower back plate 15 are respectively provided with at least one molding 10 protruding towards one side.

In the embodiment, a bottom of the supporting frame 100 is composed of a base 3, and an upper side of a rear side of the base 3 is contacted and fixedly connected with a lower side of the lower back plate 15.

In the embodiment, a top of the supporting frame 100 is provided with a table top which horizontally covers a top of the supporting frame, a rear side of the table top is provided with a flange bent downwards. A lower side of the flange is contacted and fixedly connected with an upper side of the upper back plate 14.

In this embodiment, the first clothing treating drum or the second clothing treating drum is a drying drum configured to dry clothes. A rear part of at least one clothing treating drum is fixedly mounted on the supporting frame 100 via an installation plate. A notch is provided on the upper back plate 14 and/or the lower back plate 15, and the notch and the installation plate at the rear part of the first clothing treating drum and/or the second clothing treating drum are arranged in a corresponding superposition way. Preferably, the installation plate 18 at the rear part of the first clothing treating drum and/or the second clothing treating drum is correspondingly attached to the upper back plate 14 and/or the lower back plate 15. Further preferably, the installation plate 28 at the rear part of the first clothing treating drum and the upper back plate 14 are mounted at two opposite sides of the two vertical beams 1 at the rear side of the supporting frame 100. And/or the installation plate 28 at the rear part of the second clothing treating drum and the lower back plate 15 are mounted at two opposite sides of the two vertical beams 1 at the rear side of the supporting frame 100.

In the embodiment, a top of the upper back plate 14 is an inclined plane which is gradually bent downwards from the center to two sides, so that the notch is formed between the upper back plate 14 and the supporting frame 100 at two ends of a top of a rear side of the clothing treating device. Preferably, the rear part of the first clothing treating drum is fixedly arranged on the supporting frame 100 via the installation plate 28, a water inlet 18 and a power line mounting opening 19 are respectively arranged at two ends of a top part of the installation plate 28. The water inlet and the power line mounting opening are respectively arranged corresponding to the notch between the upper back plate 14 and the supporting frame 100. Further preferably, a water outlet 17 for installing a water discharge valve is arranged at the rear side of the base 3.

Embodiment 3

As shown in FIGS. 1 to 4, the present embodiment introduces a clothing treating device. A left side plate or a right side plate of the clothing treating device is composed of the side plate described in the Embodiment 1, and a rear side plate of the clothing treating device is composed of the rear plate described in the Embodiment 2. The difference between the other side plate and the side plate described in the Embodiment 1 is that it has no air vent.

Embodiment 4

Figure 5:
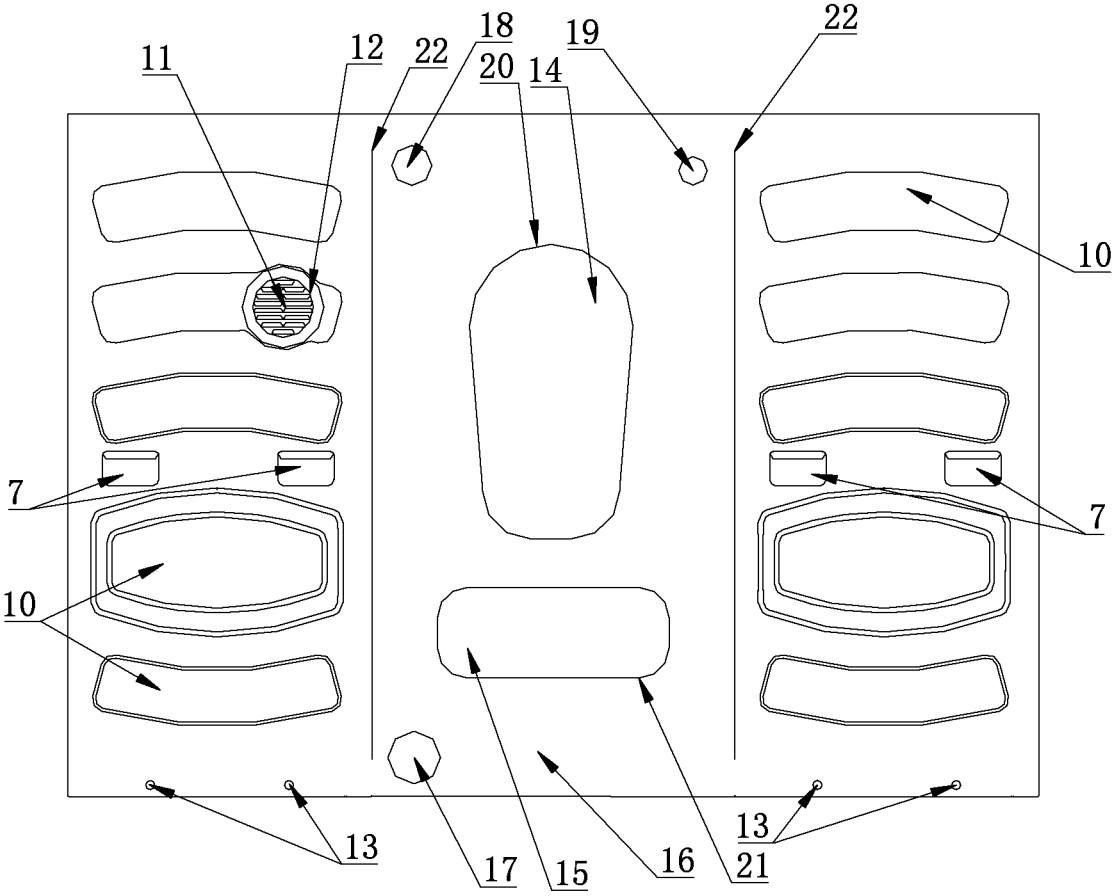
FIG. 5 is a schematic view illustrating a rear U-shaped plate structure of a clothing treating device according to an embodiment of the present disclosure.

As shown in FIG. 5, the present embodiment describes a shell structure of a clothing treating device. The shell structure comprises a rear U-shaped plate 16. The rear U-shaped plate 16 is bent at two vertical lines 22 to form a left side wall, a right side wall and a rear side wall of a shell, with a cross section being U-shaped, of the clothing treating device. An upper overhauling installation opening 20 and a lower overhauling installation opening 21 are arranged on the rear side wall. An upper rear back cover plate 14 and a lower rear back cover plate which respectively cover the upper overhauling installation opening and the lower overhauling installation opening overhauling installation openings are arranged on the rear side wall.

The shell of the clothing treating device is provided with the rear U-shaped plate comprising the left side wall, the right side wall and the rear side wall, so that the shell structure of a machine body of the clothing treating device is simplified, the strength is improved, and the assembly efficiency is improved. Simultaneously, setting up two detachable back cover plates up and down on the rear side wall of the rear U-shaped plate is convenience to assemble and maintain an upper portion and a lower portion by step.

In the present embodiment, the clothing treating device comprises a first clothing treating drum and a second clothing treating drum which are arranged in longitudinal order. The upper overhauling installation opening 20 corresponds to the first clothing treating drum and part of the second clothing treating drum, and the lower overhauling installation opening 21 corresponds to another part of the second clothing treating drum. By setting the back cover plates up and down on the rear U-shaped plate to correspond to the first clothing treating drum and the second clothing treating drum respectively, the purpose of assembling, repairing and maintaining the first clothing treating drum and the second clothing treating drum is realized, and the convenience of repairing the internal components of the clothing treating device is improved.

In this embodiment, the upper overhauling installation opening 20 is an opening with an upper horizontal width being larger than a lower horizontal width. An upper side edge of the upper overhauling installation opening 20 is an arc line segment which gradually bents downward from a center to two sides. Two side edges of the upper overhauling installation opening are line segments symmetrically about the vertical median line of the rear side wall. A lower side edge of the upper overhauling installation opening is a horizontally extending line segment. Preferably, an arc chamfer is arranged at an intersection of adjacent edges of the upper overhauling installation opening.

In this embodiment, the lower overhauling installation opening 21 is a rectangular opening, and a horizontal width of the lower overhauling installation opening 21 is larger than a maximum horizontal width of the upper overhauling installation opening. Preferably, four corners of the rectangular opening are respectively provided with arc chamfers.

In this embodiment, the upper rear back cover plate 14 and the lower rear back cover plate 15 are respectively detachably and fixedly arranged on one side of the rear side wall. Preferably, the upper rear back cover plate 14 and the lower rear back cover plate 15 are installed at a side close to an inside of the machine body, so as to prevent the rear back cover plates from protruding from the machine body and causing scratch and damage to users or articles.

In this embodiment, the upper rear back cover plate 14 is fixedly installed on the rear side wall, and part of the upper rear back cover plate 14 is correspondingly overlapped with the whole area of the upper overhauling installation opening 20 in horizontal direction. The lower rear back cover plate 15 is fixedly installed on the rear side wall, and part of the lower rear back cover plate 15 is correspondingly overlapped with the whole area of the lower overhauling installation opening 21 in horizontal direction. Further preferably, a periphery of the upper rear back cover plate 14 goes beyond the upper overhauling installation opening 20 and is attached and contacted with the rear side wall, and the attachment and contact part is detachably and fixedly mounted via at least one screw. A periphery of the lower rear back cover plate 15 goes beyond the lower overhauling installation opening 21 and is attached and contacted with rear side wall, and the attachment and contact part is detachably and fixedly mounted via at least one screw.

In this embodiment, the left side wall and the right side wall of the shell are arranged symmetrically about the vertical median line of the rear U-shaped plate 16. A middle part of the left side wall and a middle part of the right side wall of the shell are respectively provided with at least two handle parts 7. Preferably, all of the handle parts 7 are arranged at a same horizontal height of the rear U-shaped plate. Preferably, a left side and a right side of the left side wall of the shell are respectively provided with one handle part 7, and a left side and a right side of the right side wall of the shell are respectively provided with one handle part 7. Further preferably, all of the handle parts 7 are arranged at a position between the first clothing treating drum and the second clothing treating drum.

In this embodiment, an upper part of the left side wall or an upper part of the right side wall of the clothing treating device is provided with an air vent 11. The air vent 11 communicates with an end part of an air duct arranged in the clothing treating device, so that outside air flows in an inside of the air duct through the air vent. Preferably, a grid-shaped shielding cover 12 is arranged at the air vent 11, and the grid-shaped shielding cover 12 covered the air vent to prevent external water flow from flowing into the inside of the shell of the clothing treating device. Further preferably, the grid-shaped shielding cover 12 comprises horizontal shielding ribs which are horizontally arranged, an interval is formed between two adjacent horizontal shielding ribs. The horizontal shielding rib is inclined from top to bottom towards the outside of the shell of the clothing treating device to guide water flow outside the clothing treating device to flow along the horizontal shielding rib and not flow in the air vent.

In this embodiment, the left side wall and the right side wall of the clothing treating device are respectively provided with moldings 10 arranged from top to bottom at intervals. The moldings 10 arranged on the left side wall and the moldings 10 arranged on the right side wall are symmetrically. Preferably, the air vent 11 is at least partially overlapped with the molding 10 of a side wall of the clothing treating device. Further preferably, an upper side and a lower side of the handle part 7 are respectively arranged close to the moldings 10 in an adjacent manner.

In this embodiment, a lower part of the left side wall and a lower part of the right side wall of the clothing treating device are provided with screw holes 13 which are horizontally arranged at intervals, so that screws pass through the screw holes 13 to fixedly connect the rear U-shaped plate with a supporting frame of the clothing treatment device.

Embodiment 5

Figure 6:
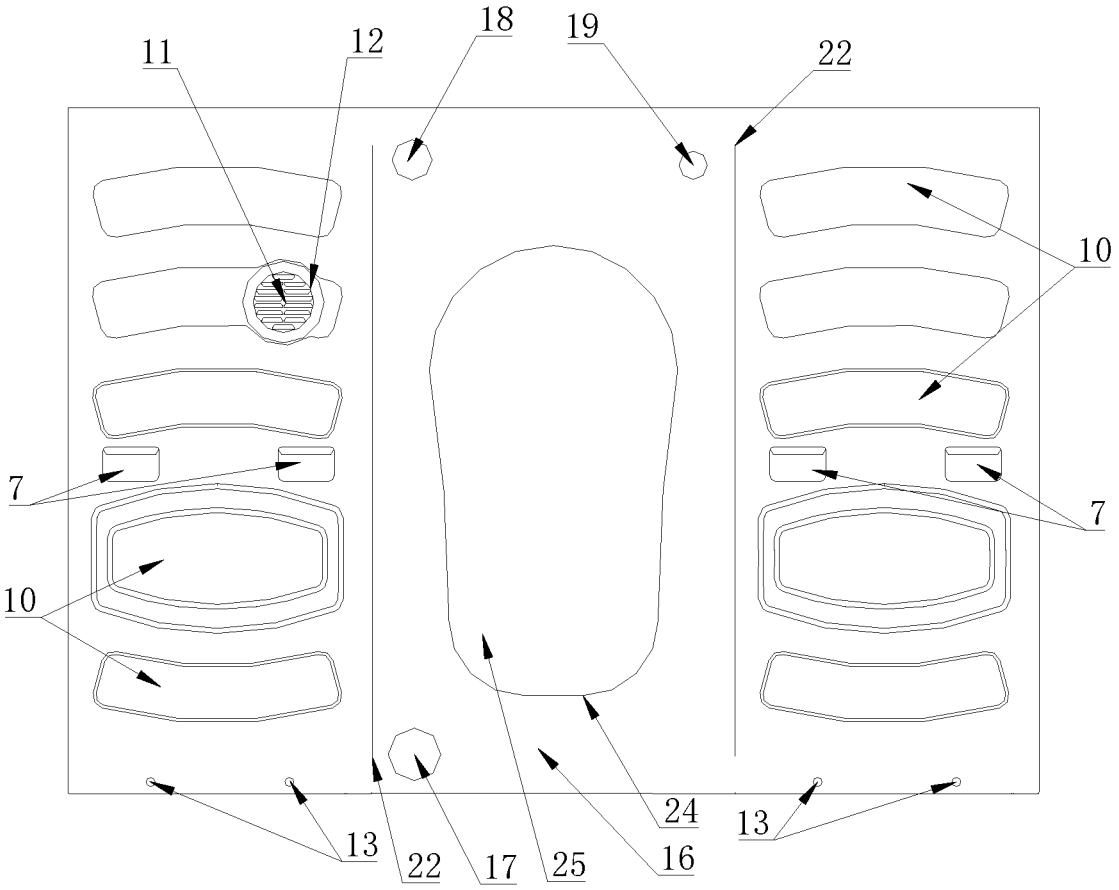
FIG. 6 is a schematic view illustrating a rear U-shaped plate structure of a clothing treating device according to another embodiment of the present disclosure.

As shown in FIG. 6, in the present embodiment, a shell structure of a clothing treating device is disclosed. The shell comprises a rear U-shaped plate 16. The rear U-shaped plate 16 is bent at two vertical lines 22 to form a left side wall, a right side wall and a rear side wall of a shell, a cross section being U-shaped, of the clothing treating device. The left side wall and the right side wall of the shell are respectively provided with at least one handle part 7. The rear U-shaped plate 16 is also provided with an air vent 11 communicated with an inside of the shell.

The shell of the clothing treating device is provided with the rear U-shaped plate comprising the left side wall, the right side wall and the rear side wall, so that the shell structure of a machine body of the clothing treating device is simplified, the strength is improved, and the assembly efficiency is improved. Meanwhile, the air vent is integrally formed on the rear U-shaped plate, so that heat dissipation and ventilation in the clothes treatment device are facilitated. Also, the air duct arranged in the clothing treating device is communicated with the air vent, so that the purpose of exchanging air with an outside through the air vent arranged on the shell is realized.

In this embodiment, the left side wall and the right side wall of the shell are symmetrically about a vertical median line of the rear U-shaped plate 16. A middle part of the left side wall and a middle part of the right side wall of the shell are respectively provided with at least two handle parts 7. All of the handle parts are arranged at a same horizontal height of the rear U-shaped plate 16. Preferably, a left side and a right side of the left side wall of the shell are respectively provided with one handle part 7, and a left side and a right side of the right side wall of the shell are respectively provided with one handle part 7.

In this embodiment, the handle part 7 comprises a handle body fixedly mounted on the rear U-shaped plate 16. A groove sunk towards an inside of the clothing treating device is arranged on the handle body, and an opening of the groove faces an outside of the clothing treating device. Preferably, the opening of the groove faces the outside of the clothing treating device and is inclined downward.

In the present embodiment, the clothing treating device comprises a first clothing treating drum and a second clothing treating drum which are arranged in longitudinal order. The handle part 7 is arranged at a position between the first clothing treating drum and the second clothing treating drum.

In this embodiment, the air vent 11 is arranged on an upper part of the left side wall or the right side wall of the clothing treating device. The air vent communicates with an end part of an air duct arranged in the clothing treating device, so that outside air flows in an inside of the air duct through the air vent. By setting the air vent on the upper part of the side plate, the air vent of the clothing treating device is arranged on an upper part of a machine body, so that the air flowing out or flowing in through the air vent is the air flow on the upper side of the machine body, so as to reduce the interference of the ventilation airflow on the users operating the machine and improve the user's experience effect.

In this embodiment, a grid-shaped shielding cover 12 is arranged at the air vent 11, and the grid-shaped shielding cover 12 covers the air vent 11 to prevent external water flow from flowing into the inside of the shell of the clothing treating device.

In this embodiment, the grid-shaped shielding cover 12 comprises horizontal shielding ribs which are horizontally arranged, an interval is formed between two adjacent horizontal shielding ribs. The horizontal shielding rib is inclined from top to bottom towards the outside of the shell of the clothing treating device to guide water flow outside the clothing treating device to flow along the horizontal shielding rib and not flow in the air vent. Preferably, upper sides of the horizontal shielding ribs are arranged on a same vertical plane, and an interval is formed between a lower side of one horizontal shielding rib and the upper side of another horizontal shielding rib adjacent to and below the one horizontal shielding rib to allow air flow to pass through the air vent through the interval. Further preferably, the lower side of one horizontal shielding rib is lower than or flushes with the upper side of another horizontal shielding rib adjacent to and below the one horizontal shielding rib.

In the embodiment, two ends of each the horizontal shielding ribs are respectively fixed on a supporting ring. A size of a periphery of the supporting ring is equal to a perimeter of the air vent and the supporting ring is hermetically connected with the air vent. Preferably, the grid-shaped shielding cover is provided with at least one vertical shielding rib extending vertically, two ends of the vertical shielding rib are fixedly connected with the supporting ring respectively. The vertical shielding rib sequentially penetrates through the horizontal shielding ribs and is fixedly connected with the horizontal shielding ribs. Further preferably, the grid-shaped shielding cover is integrally with the rear U-shaped plate of the clothing treating device.

In this embodiment, the left side wall and the right side wall of the clothing treating device are respectively provided with moldings 10 arranged from top to bottom at intervals. The moldings 10 arranged on the left side wall and the moldings 10 arranged on the right side wall are symmetrically arranged. Preferably, the air vent 11 is at least partially overlapped with the molding 10 of a side wall of the clothing treating device. Further preferably, an upper side and a lower side of the handle part 7 are respectively arranged close to the moldings 10 in an adjacent manner.

In this embodiment, a lower part of the left side wall and a lower part of the right side wall of the clothing treating device are provided with screw holes which are horizontally arranged at intervals, so that screws pass through the screw holes to fixedly connect the side walls with a supporting frame of the clothing treatment device. Preferably, a water outlet 17 is arranged on a lower end of the rear side wall of the clothing treating device, and a water inlet 18 is arranged on one side of an upper end of the rear side wall, and a power line mounting opening 19 is arranged on another side of the upper end of the rear side wall. Further preferably, the rear side wall is provided with an overhauling installation opening 24, a rear back cover plate 25 is detachably installed on the rear U-shaped plate 16, and the rear back cover plate 25 is fixedly installed and covers the overhauling installation opening 24.

Embodiment 6

Figure 10:
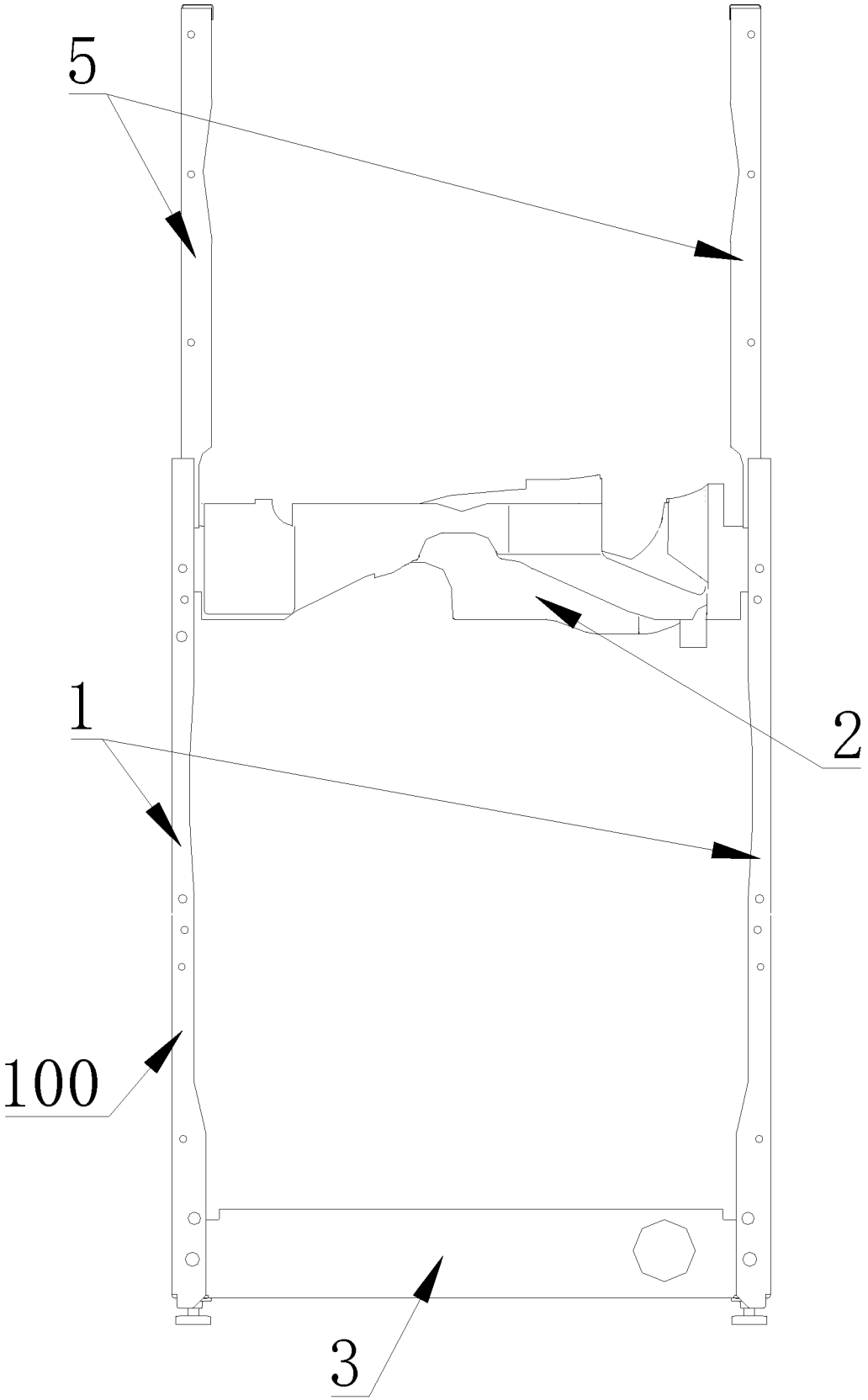
FIG. 10 is a schematic view of a supporting frame structure of a clothing treating device according to an embodiment of the present disclosure.
Figure 11:
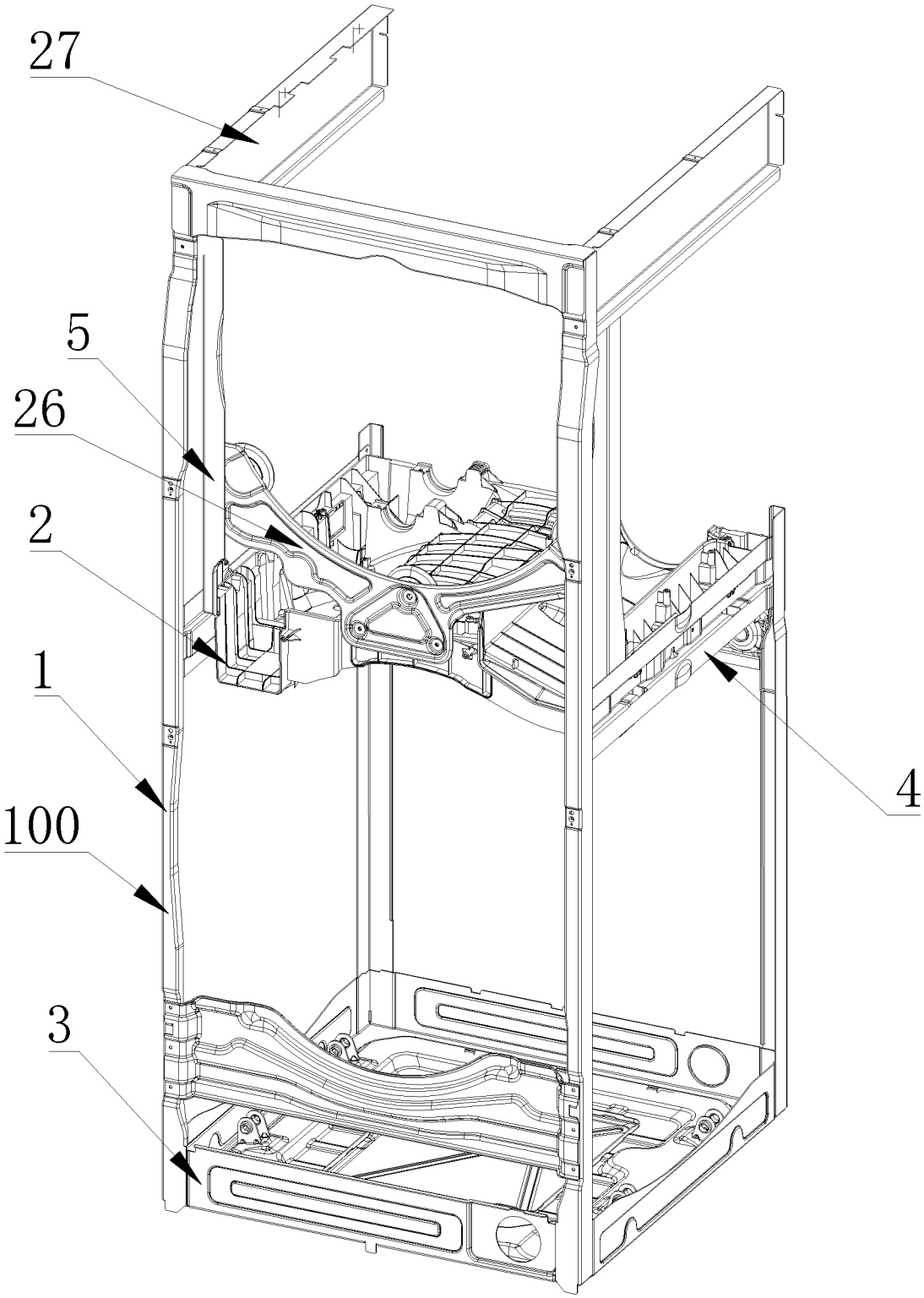
FIGS. 11 and 12 are schematic views illustrating an installation structure of a clothing treating device according to an embodiment of the present disclosure.
Figure 12:
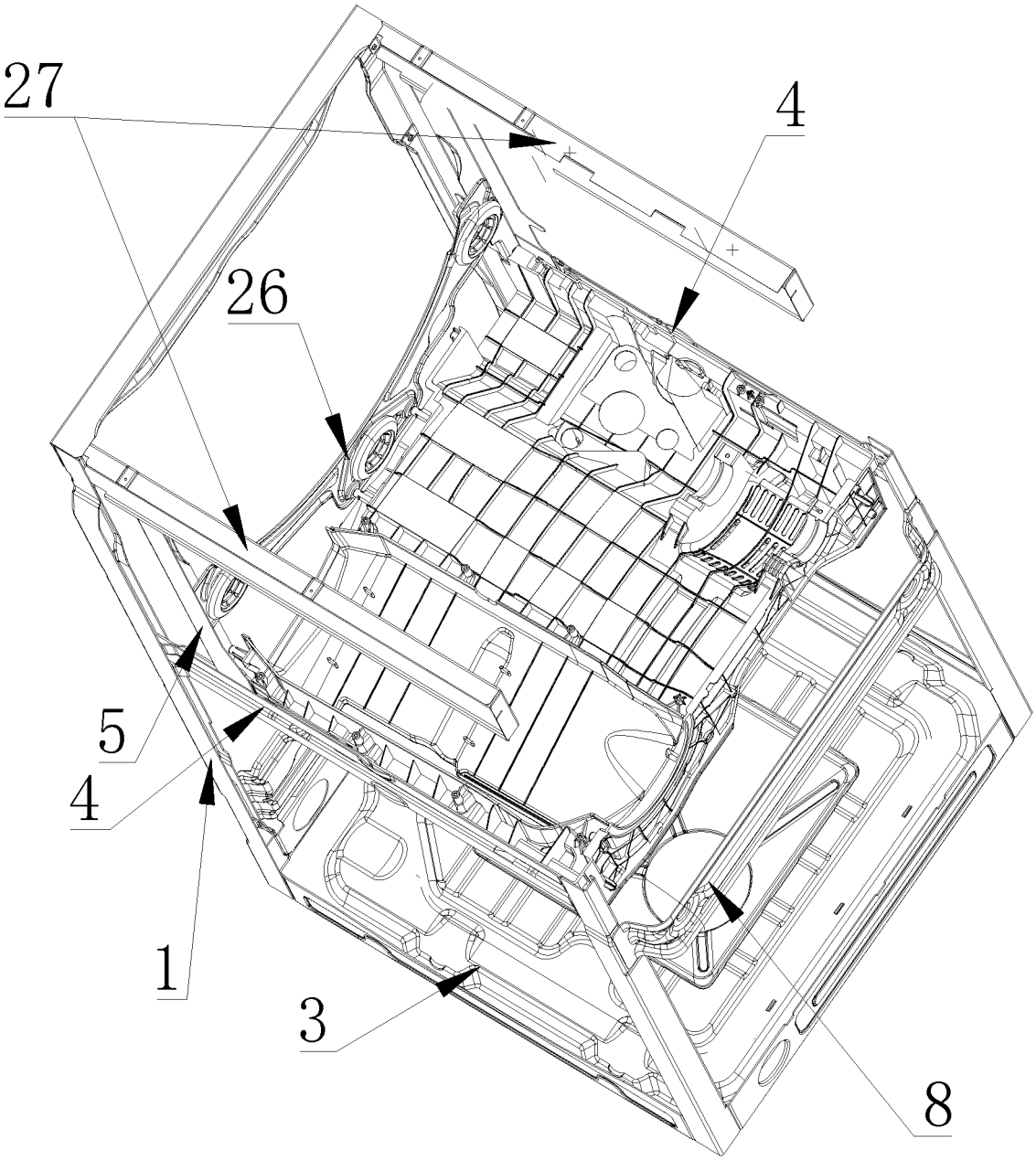

As shown in FIGS. 10 to 12, an embodiment of the present disclosure introduces a frame structure of a clothing treating device. The clothing treating device comprises a supporting frame 100, a first clothing treating drum and a second clothing treating drum arranged longitudinally. An upper drum base 2 is arranged between the first clothing treating drum and the second clothing treating drum and is fixedly connected with the supporting frame 100 of the clothing treating device.

The upper drum base horizontally arranged is fixedly mounted at a middle portion of the supporting frame, so that an upper clothing treating drum and a lower clothing treating drum of the clothing treating device are correspondingly mounted on different bases. Thereby further ensure that the two clothing treating drums may be separately supported effectively and fixedly mounted. In addition, the upper drum base is arranged between the first clothing treating drum and the second clothing treating drum for supporting and fixing the first clothing treating drum to isolate the two clothing treating drums, so that noise and vibration of the two clothing treating drums are separated from each other, thereby avoiding resonance and preventing occurrence of excessive noise and excessively severe vibration during machine operation.

In the embodiment, the supporting frame 100 comprises a base 3 placed horizontally, and the base is square. Four corners of the base 3 are provided with vertical beams 1 extending vertically upwards. Two adjacent vertical beams 1 on a left side and two adjacent vertical beams 1 on a right side are respectively connected by middle reinforcing members 4, and the upper drum base 2 is fixedly mounted on the middle reinforcing members 4. Reinforcing members are arranged at the middle portions of the left and right sides of the supporting frame in order to provide an effectively supporting plane for the upper drum base to thereby reliably mount and fix the upper drum base on the supporting frame.

In the embodiment, the upper drum base 2 has a sheet-like structure horizontally extending, and left side and right side of the upper drum base 2 are respectively lapped on the middle reinforcing members 4 on the corresponding sides and fixedly connected therewith by screws.

In the embodiment, the middle reinforcing members 4 are strip-shaped sheets extending along a horizontal direction in a vertical plane. A left side wall and a right side wall of the upper drum base 2 are respectively attached to and in contact with inner side walls of the middle reinforcing members 4 of corresponding sides and are fixedly connected therewith by at least one screw at the corresponding attaching and contacting positions.

In the embodiment, middle portions of the middle reinforcing members 4 are provided with support moldings that protrude towards inside of the supporting frame, the support moldings extend along the horizontal direction. A lower wall of a lateral portion of the upper drum base 2 is correspondingly lapped on upper side surfaces of the support moldings. By providing two relatively protruding support moldings on the middle reinforcing members, the upper drum base can be conveniently lapped on the upper side surfaces of the support moldings, thereby achieving a purpose of pre-positioning and mounting the upper drum base.

In the embodiment, front ends of the two middle reinforcing members 4 are respectively provided with upper vertical beams 5 extending vertically upwards. Lower ends of the upper vertical beams 5 are fixedly connected to the middle reinforcing members 4 and/or the upper drum base 2.

In the embodiment, a front reinforcing member of an upper drum 26 is mounted at the front end of the upper drum base 2, and is fixedly connected to two upper vertical beams 5 respectively. Preferably, the front reinforcing member of the upper drum 26 is an arch-shaped sheet bent upwards from a middle portion towards two ends respectively. The middle portion of the front reinforcing member of the upper drum 26 is fixedly connected with a middle portion of the front end of the upper drum base 2, and two ends of the front reinforcing member of the upper drum 26 are fixedly connected with the upper vertical beams 5 on the corresponding sides respectively.

In the embodiment, the upper vertical beams 5 are composed of strip-shaped sheets extending vertically with L-shaped cross sections. Inner sides of lower ends of the upper vertical beams 5 are attached to and in contact with outer side walls of corresponding corners of the upper drum base 2, and the lower ends of the upper vertical beams 5 are correspondingly lapped on the support moldings arranged on the middle reinforcing members 4 on the corresponding sides. Preferably, corresponding attaching and contacting positions of the upper vertical beams 5 and the upper drum base 2 are fixedly connected by at least one screw.

Embodiment 7

Figure 7:
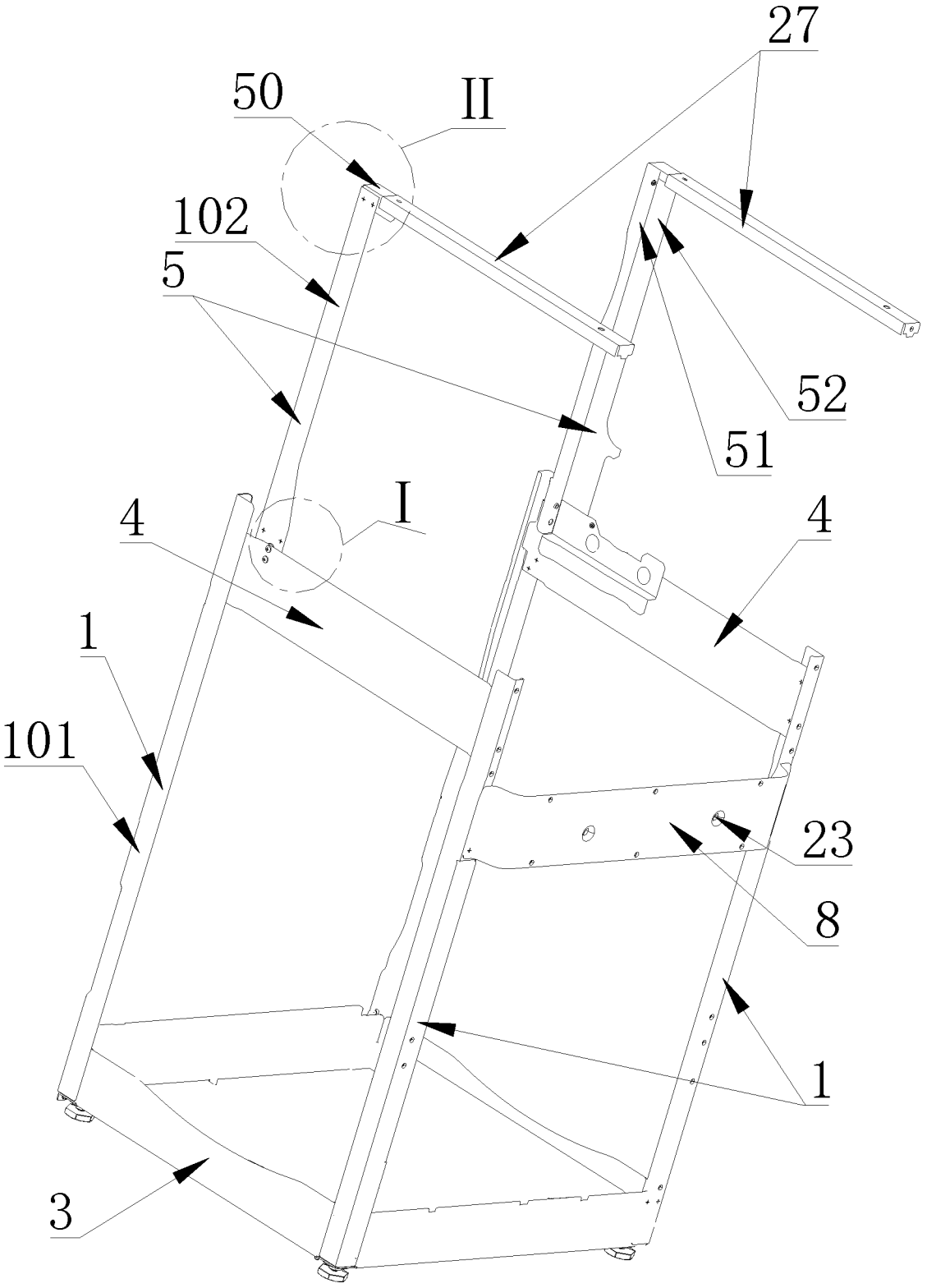
FIG. 7 is a schematic view illustrating a structure of a supporting frame of a clothing treating device according to an embodiment of the present disclosure.
Figure 8:
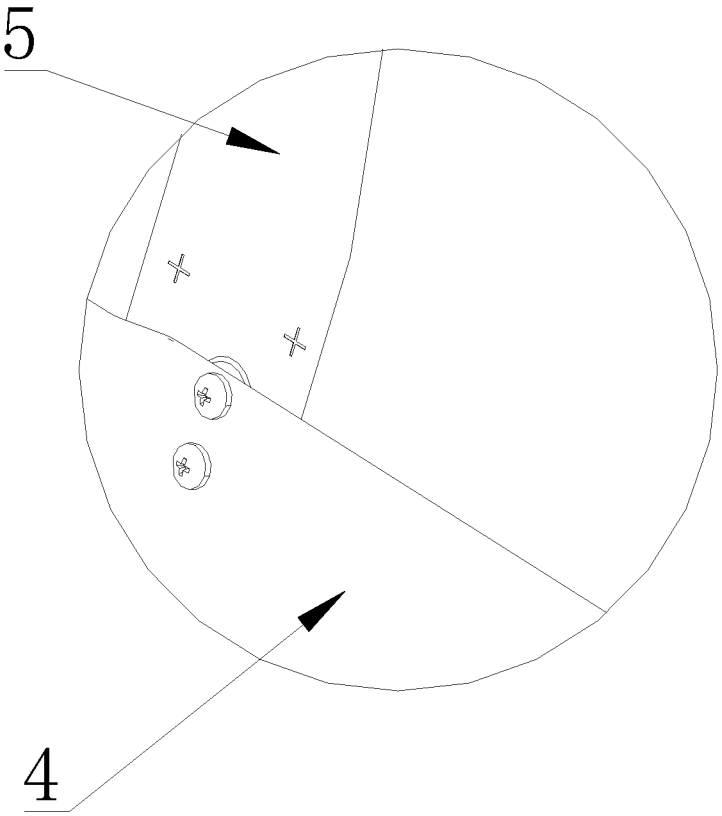
FIG. 8 is an enlarged structural view taken at I in FIG. 7 according to an embodiment of the present disclosure.
Figure 9:
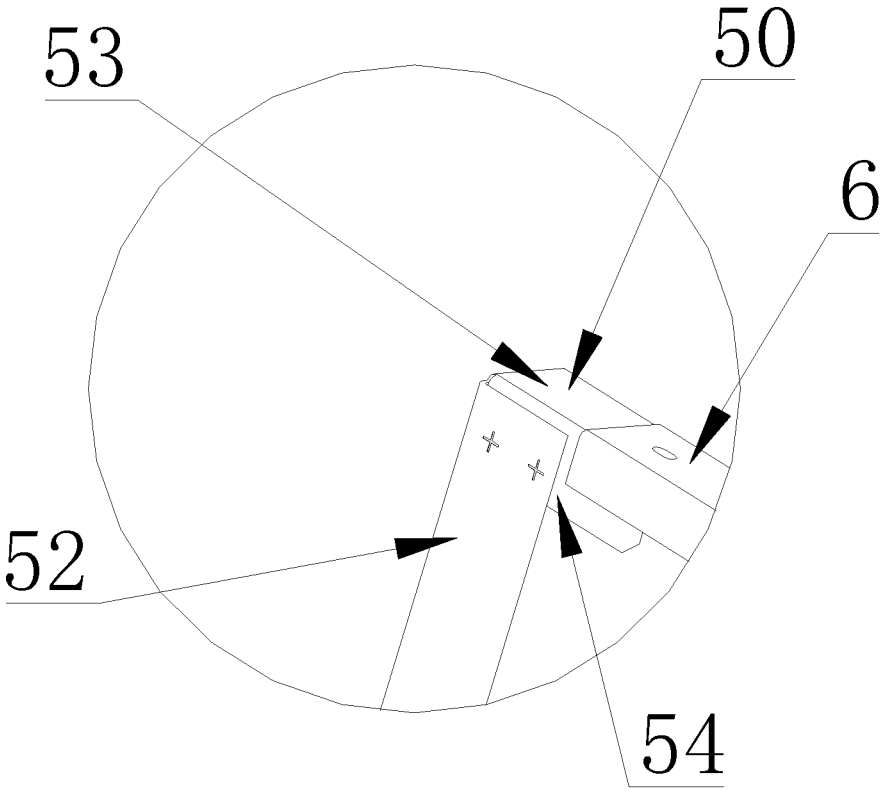
FIG. 9 is an enlarged structural view taken at II in FIG. 7 according to an embodiment of the present disclosure.

As shown in FIGS. 7-9, the embodiment introduces a supporting frame of a clothing treating device. The clothing treating device comprises a first clothing treating drum and a second clothing treating drum which are arranged in longitudinal order. The supporting frame 100 comprises a lower supporting frame 101 configured to place the second clothing treating drum. An upper supporting frame 102 extending upwards is mounted on a top of the lower supporting frame 101, and is configured to mount the first clothing treating drum.

The objective of replacing and repairing parts of the supporting frame may be achieved by setting the supporting frame as the upper frame and the lower frame independent from each other. Meanwhile, the first clothing treating drum and the second clothing treating drum are respectively mounted in corresponding parts of the supporting frame in order to realize a modular management of the device. So that a device with only the second clothing treating drum and a device with both the first and second clothing treating drums may be produced on the same production line, thereby improving modularity of the device and reducing production cost.

As shown in FIG. 7, in the embodiment, the lower supporting frame 101 comprises a base 3 placed horizontally, and the base 3 is square. Four corners of the base 3 are respectively provided with vertical beams 1 extending vertically upwards. At least one pair of adjacent vertical beams 1 is fixed via a middle reinforcing member 4 to enclose a frame structure for mounting the second clothing treating drum. Preferably, adjacent vertical beams on a left side are fixedly connected respectively via a left middle reinforcing member, and adjacent vertical beams on a right side are fixedly connected respectively via a right middle reinforcing member. Further preferably, the left middle reinforcing member and the right middle reinforcing member are arranged symmetrically.

In the embodiment, the upper supporting frame 102 comprises two upper vertical beams 5 extending vertically upwards arranged at a left end and a right end near a front side of the supporting frame. Lower ends of the two upper vertical beams 5 are both fixedly connected with the lower supporting frame 101, and tops of the two upper vertical beams 5 are respectively connected with upper reinforcing members 27 extending rearwards of the supporting frame.

In the embodiment, the lower ends of the upper vertical beams 5 of the upper supporting frame 102 are fixedly connected with the middle reinforcing members 4 of the lower supporting frame 101 and/or upper ends of the vertical beams 1.

As shown in FIG. 8, in the embodiment, the lower ends of the upper vertical beams 5 are correspondingly attached to and in contact with the middle reinforcing members 4 and/or the upper ends of the vertical beams 1 and are fixedly connected therewith by screws. Preferably, outer sides of the lower ends of the upper vertical beams 5 and inner sides of the middle reinforcing members 4 are correspondingly attached. The upper vertical beams 5 are fixedly connected with the middle reinforcing members 4 by two longitudinally arranged screws connected at the attaching and contacting positions. By attaching the lower ends of the upper vertical beams and the middle reinforcing members at a predetermined position and then performing fastening, assembling and connecting via screws, assembling stability and mounting efficiency of the upper vertical beams and the lower frame are significantly improved.

As shown in FIG. 9, in the embodiment, top ends of the upper vertical beams 5 are provided with flanges 50 bent horizontally rearwards, and end portions of the upper reinforcing members 27 are correspondingly lapped on upper sides of the flanges 50 in an attaching manner and fixedly connected therewith via screws.

Preferably, each of the upper vertical beams 5 having L-shaped cross sections is composed of a front side plate and a lateral side plate in strip shape, the front side plate 51 is parallel to or overlapped with a front side of the supporting frame 100 and the lateral side plate 52 is parallel to or overlapped with a lateral portion of the supporting frame 100. An upper end of the lateral side plate 51 is provided with a notch extending horizontally, an upper end of the front side plate 52 is provided with a fold line extending horizontally. The fold line and the notch are arranged to be aligned with the notch so that the flanges 50 are formed by bent portions, formed by rearwards bending upper ends of the upper vertical beams by 90° around the fold lines, of the upper vertical beams 5.

In the embodiment, the flanges 50 comprise horizontal flanges 53 horizontally bent rearwards by tops of the front side plates of the upper vertical beams 5 and vertical flanges 54 vertically bent downwards by lateral portions of the horizontal flanges. The vertical flanges 54 and the lateral side plates 52 of the upper vertical beams 5 are correspondingly arranged in an attaching manner and riveted to be fixed.

The end portions of the upper reinforcing members 27 are lapped on upper sides of the horizontal flanges 53 and connected therewith via screws. Preferably, rearward extending lengths of the horizontal flanges 53 are greater than horizontal widths of the lateral side plates 52 of the upper vertical beams 5, so that the end portions of the horizontal flanges 53 protrude from the upper vertical beams 5 and are provided for attaching and lapping the upper reinforcing members 27.

In the embodiment, the upper reinforcing members 27 have strip-shaped structures with L-shaped cross sections, and inner walls of the upper reinforcing members 27 are correspondingly in contact with the upper sides of the horizontal flanges 53 and outer sides of the vertical flanges 54 respectively in a limiting manner. By attaching the upper reinforcing members correspondingly at the corresponding flanges, assembly support points of the upper reinforcing members are improved, thereby significantly improving stability of the entire device.

In the embodiment, a rear side of the lower supporting frame 101 is further provided with a middle rear reinforcing member 8. The middle rear reinforcing member 8 extends horizontally, and two ends of the middle rear reinforcing member 8 are respectively fixedly connected with upper portions of the two vertical beams 11 at the rear side.

In the embodiment, rear ends of the two upper reinforcing members 27 are respectively configured to connect with a mounting plate 28 of the first clothing treating drum. The lower frame is configured to fixedly connect with a lower end of the rear fixing plate. By means of the above setting, the first clothing treating drum having only a drying function in the upper portion is correspondingly mounted in the upper frame and a seal fixation of a rear side of an upper portion of a machine body is also ensured, so that the rear fixing plate of the first clothing treating drum has functions of connecting the reinforcing members as well as forming part of the supporting frame.

Solutions for carrying out the above embodiments may be further combined or replaced, and the embodiments are merely used to describe the preferred embodiments of the present disclosure rather than limiting the concept and scope of the present disclosure. Without departing from the spirit of the design of the present disclosure, variations and improvements to the technical solutions of the present disclosure by those skilled in the art all fall into the protection scope of the present disclosure.

The invention claimed is:

1. A shell structure for a clothing treating device having a first clothing treating drum and a second clothing treating drum which are arranged in longitudinal order, the shell structure comprising:

a rear U-shaped plate, the rear U-shaped plate is bent at two vertical lines to form a left side wall, a right side wall and a rear side wall of a shell, with a cross section being U-shaped, of the clothing treating device, wherein the left side wall and the right side wall of the shell are respectively provided with at least one handle part, and the rear U-shaped plate is provided with an air vent communicated with an inside of the shell;

an upper overhauling installation opening and a lower overhauling installation opening arranged on the rear side wall, and an upper rear back cover plate and a lower rear back cover plate which respectively cover the upper overhauling installation opening and the lower overhauling installation opening, wherein the upper overhauling installation opening corresponds to the first clothing treating drum and part of the second clothing treating drum, and the lower overhauling installation opening corresponds to at least another part of the second clothing treating drum.

2. The shell structure of the clothing treating device according to claim 1, wherein the at least one handle parts are arranged at a position between the first clothing treating drum and the second clothing treating drum.

3. The shell structure of the clothing treating device according to claim 1, wherein the air vent is arranged on an upper part of the left side wall or an upper part of the right side wall, formed by the rear U-shaped plate, of the clothing treating device, and the air vent communicates with an end part of an air duct arranged in the clothing treating device, so that outside air flows in an inside of the air duct through the air vent.

4. The shell structure of the clothing treating device according to claim 3, comprising:

a grid-shaped shielding cover arranged at the air vent, and the grid-shaped shielding cover covers the air vent to prevent external water flow from flowing into the inside of the shell of the clothing treating device;

the grid-shaped shielding cover comprises horizontal shielding ribs which are horizontally arranged, an interval is formed between two adjacent horizontal shielding ribs, and each of the horizontal shielding ribs is inclined from top to bottom towards the outside of the shell of the clothing treating device to guide water flow outside the clothing treating device to flow along the horizontal shielding rib and not flow in the air vent;

upper sides of the horizontal shielding ribs are arranged on a same vertical plane, and an interval is formed between a lower side of one horizontal shielding rib and an upper side of another horizontal shielding rib adjacent to and below the one horizontal shielding rib to allow air flow to pass through the air vent through the interval;

the lower side of the one horizontal shielding rib is lower than or flushes with the upper side of the other horizontal shielding rib adjacent to and below the one horizontal shielding rib.

5. The shell structure of the clothing treating device according to claim 4, wherein two ends of each of the horizontal shielding ribs are respectively fixed on a supporting ring, and a size of a periphery of the supporting ring is equal to a perimeter of the air vent and the supporting ring is hermetically connected with the air vent;

the grid-shaped shielding cover is provided with at least one vertical shielding rib extending vertically, two ends of the at least one vertical shielding rib are fixedly connected with the supporting ring respectively, and the at least one vertical shielding rib sequentially penetrates through the horizontal shielding ribs and are fixedly connected with the horizontal shielding ribs.

6. The shell structure of the clothing treating device according to claim 1, wherein the left side wall and the right side wall of the clothing treating device are respectively provided with moldings arranged from top to bottom at intervals, and the moldings arranged on the left side wall and the moldings arranged on the right side wall are arranged symmetrically.

7. The shell structure of the clothing treating device according to claim 1, wherein a lower part of the left side wall and a lower part of the right side wall of the clothing treating device are provided with screw holes which are horizontally arranged at intervals, so that screws pass through the screw holes to fixedly connect the rear U-shaped plate with a supporting frame of the clothing treatment device;

a water outlet is arranged on a lower end of the rear side wall of the clothing treating device, and a water inlet is arranged on one side of an upper end of the rear side wall, and a power line mounting opening is arranged on another side of the upper end of the rear side wall.

8. The shell structure of the clothing treating device according to claim 1, wherein the upper overhauling installation opening is an opening with an upper horizontal width being larger than a lower horizontal width, and an upper side edge of the upper overhauling installation opening is an arc line segment which gradually bents downward from a center to two sides, two side edges of the upper overhauling installation opening are line segments symmetrically arranged about a vertical median line of the rear side wall, and a lower side edge of the upper overhauling installation opening is a horizontally extending line segment.

9. The shell structure of the clothing treating device according to claim 1, wherein the lower overhauling installation opening is a rectangular opening, and a horizontal width of the lower overhauling installation opening is larger than a maximum horizontal width of the upper overhauling installation opening.

10. The shell structure of the clothing treating device according to claim 1, wherein the upper rear back cover plate and the lower rear back cover plate are respectively detachably and fixedly arranged on one side of the rear side wall;

the upper rear back cover plate is fixedly installed on the rear side wall, and part of the upper rear back cover plate is correspondingly overlapped with the whole area of the upper overhauling installation opening in horizontal direction;

the lower rear back cover plate is fixedly installed on the rear side wall, and part of the lower rear back cover plate is correspondingly overlapped with the whole area of the lower overhauling installation opening in horizontal direction.

* * * * *